United States Patent [19]

Nakahama et al.

[11] Patent Number: 4,850,911

[45] Date of Patent: Jul. 25, 1989

[54] POWER TRANSMISSION DEVICE FOR INBOARD/OUTBOARD SYSTEM

[75] Inventors: Ryoji Nakahama; Naoyoshi Kuragaki, both of Hamamatsu, Japan

[73] Assignee: Sanshin Kogyo Kabushiki Kaisha, Hamamatsu, Japan

[21] Appl. No.: 273,744

[22] Filed: Nov. 16, 1988

Related U.S. Application Data

[63] Continuation of Ser. No. 50,619, May 15, 1987, abandoned.

[30] Foreign Application Priority Data

May 15, 1986 [JP] Japan ..... 61-109442
Dec. 27, 1986 [JP] Japan ..... 61-309203

[51] Int. Cl.[4] ..... B63H 23/06
[52] U.S. Cl. ..... 440/86; 440/75
[58] Field of Search ..... 440/53, 54, 49, 75, 440/76, 8 A, 86, 88, 111, 900

[56] References Cited

U.S. PATENT DOCUMENTS

| | | | |
|---|---|---|---|
| 1,671,480 | 5/1928 | Metten | 440/86 |
| 2,751,749 | 6/1956 | Long | 440/86 |
| 3,113,549 | 12/1968 | Frank | 440/86 |
| 3,136,284 | 6/1964 | North | 440/86 |
| 3,256,852 | 6/1966 | Warbsrton | 440/86 |
| 3,347,647 | 9/1968 | Alexander | 440/86 |
| 4,395,240 | 7/1983 | Blanchard | 440/86 |

FOREIGN PATENT DOCUMENTS

| | | | |
|---|---|---|---|
| 58-12628 | 9/1983 | Japan | 440/86 |
| 59-4879 | 2/1984 | Japan | 440/86 |

*Primary Examiner*—Joseph F. Peters, Jr.
*Assistant Examiner*—Clifford T. Bartz
*Attorney, Agent, or Firm*—Ernest A. Beutler

[57] ABSTRACT

Several embodiments of marine outboard drives having a horizontally disposed input shaft and a vertically disposed drive shaft with a transmission means for driving the drive shaft from the input shaft. In accordance with the invention, the transmission means comprises a selectively operable coupling position rearwardly of the drive shaft so as to not interfere with tilting movement of the outboard drive about a horizontally disposed pivot axis.

10 Claims, 7 Drawing Sheets

POWER TRANSMISSION DEVICE FOR INBOARD/OUTBOARD SYSTEM

This is a continuation of U.S. patent application Ser. No. 50,619 filed May 15, 1987, now abandoned.

BACKGROUND OF THE INVENTION

This invention relates to a power transmission device for an inboard/outboard drive system and more particularly to an improved, compact and efficient drive arrangement for an outboard drive system.

Many common forms of outboard drives for watercraft employ a horizontally extending input shaft that extends through the transom of the watercraft and which forms the input for the outboard drive. Some form of transmission drives a vertically extending drive shaft from the horizontally extending input shaft. In many forms, this transmission comprises a forward, reverse transmission that is selectively engaged by a clutching mechanism that is disposed between a pair of axially spaced bevel gears that are journaled on the input shaft and which may be selectively coupled to it for effecting forward or reverse drive of a bevel gear affixed to the upper end of the drive shaft. In some instances, there is also incorporated a change speed transmission at the connection between the input shaft and the drive shaft. Although such arrangements have certain advantages in that they reduce the shock and noise during shifting and can avoid slippage at low speeds, the bulk of the transmission with this type of arrangement limits the amount of tilting up of the outboard drive that is possible.

It is, therefore, a principal object of this invention to provide an improved, compact and yet highly efficient transmission system for an outboard drive.

It is a further object of this invention to provide a transmission system for an outboard drive embodying a rearwardly positioned coupling between the drive shaft and input shaft so as to not interfere with the amount of possible pivotal movement of the outboard drive.

SUMMARY OF THE INVENTION

This invention is adapted to be embodied in an outboard drive arrangement for a watercraft that comprises an outer housing that is adapted to be supported for pivotal movement relative to a transom of the watercraft about a generally horizontally extending pivot axis. A generally horizontally extending input shaft is journaled within the outer housing and a drive shaft is journaled for rotation about a generally vertically extending axis within the outer housing. Transmission means are provided for driving the drive shaft from the input shaft and propulsion means are driven at the lower end of the drive shaft for powering the associated watercraft. In accordance with the invention, the transmission means comprises a coupling means that is positioned within the outer housing rearwardly from the drive shaft.

DETAILED DESCRIPTION OF THE PREFERRED EMBODIMENTS

Embodiment Of FIGS. 1 Through 10

Figure 1:
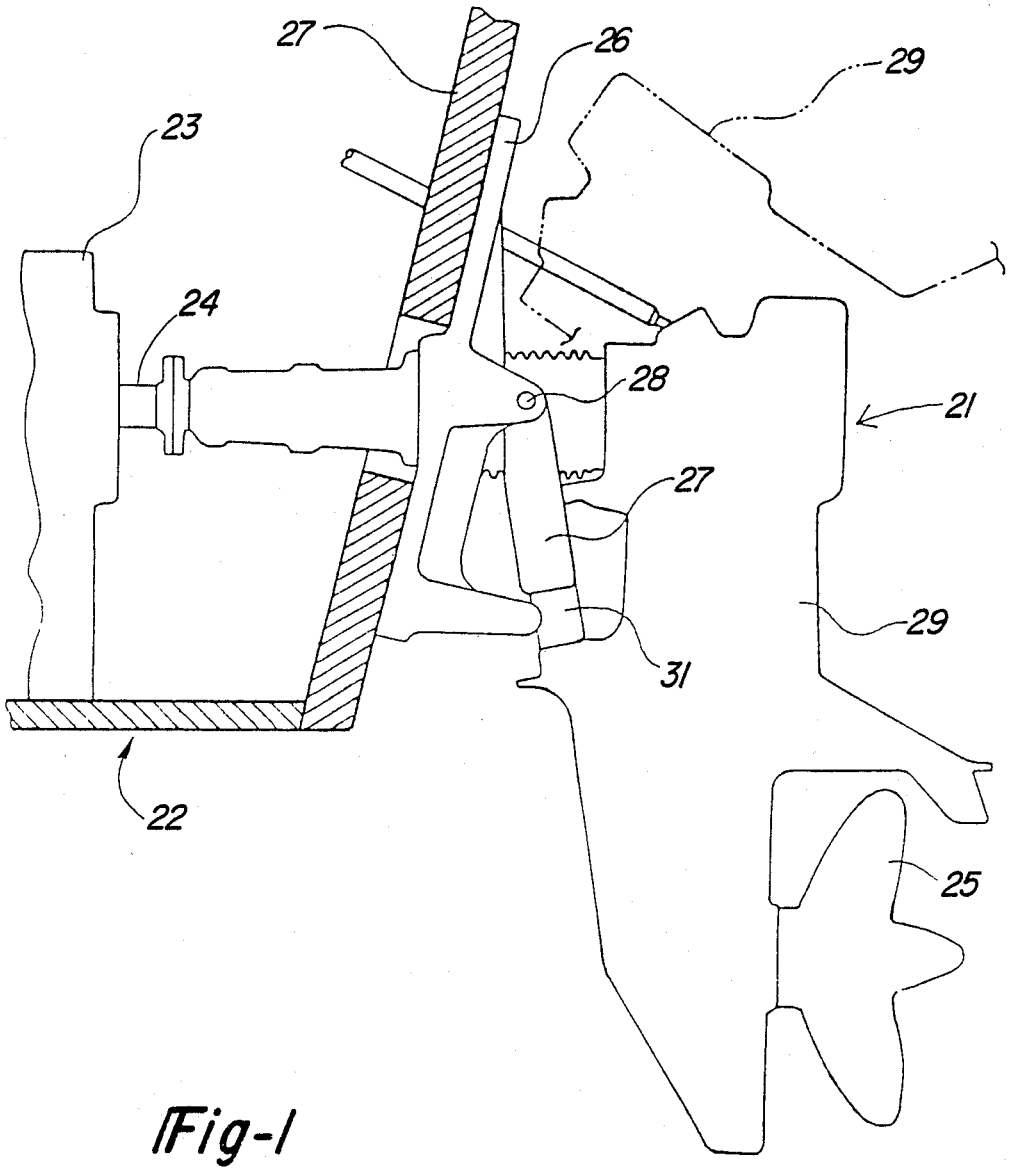
FIG. 1 is a side elevational view of an outboard drive constructed in accordance with a first embodiment of the invention. The solid line view shows the outboard drive in its normal, tilted down running condition and the phantom line view shows the outboard drive in a tilted up, out of the water condition.

Referring first to FIG. 1, an outboard drive constructed in accordance with a first embodiment of the invention is identified generally by the reference numeral 21. The outboard drive 21 is provided for propelling a watercraft, shown partially in cross-section and identified generally by the reference numeral 22. To this end, the outboard drive 21 forms the final drive portion of an inboard/outboard drive assembly that includes an internal combustion engine 23 that is supported within the hull of the watercraft 22 in any known manner and which drives an output shaft 24. Drive is transferred from the output shaft 24 to a propeller 25 of the outboard drive unit 21 by a transmission mechanism to be desribed.

The outboard drive unit 21 includes a transom bracket 26 that is affixed in a known manner to a transom 27 of the watercraft 22. A swivel bracket 27 is pivotally connected to the transom bracket 26 by means of a horizontally disposed pivot pin 28 for tilting of the outboard drive unit 21 from a normal running condition as shown in solid line view in FIG. 1 through a plurality of trim adjusted positions to a tilted up out of the water position as shown in the phantom line view.

The outboard drive unit 21 includes an outer housing 29 that is connected by means including a cylindrical member 31 to the swivel bracket 24 for steering movement about a generally vertically extending steering axis. The outer housing 29 may be steered in any known manner.

Figure 2:
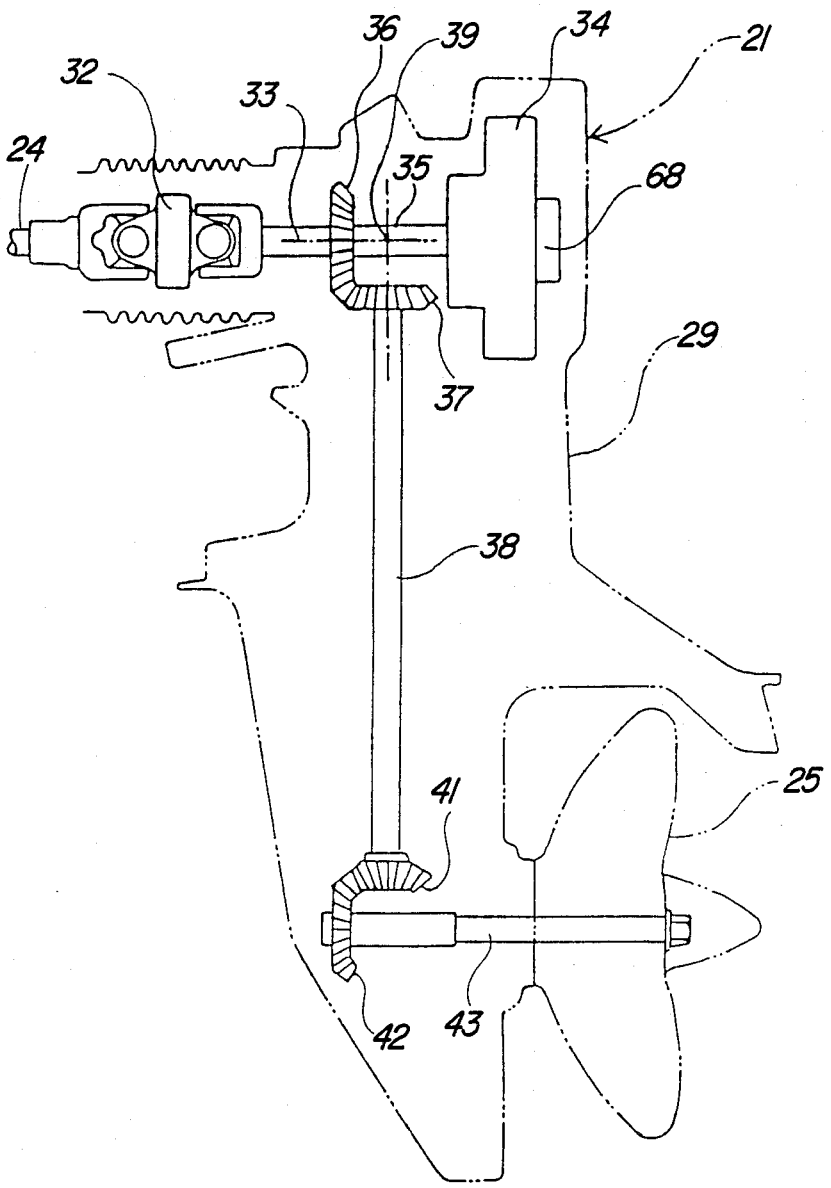
FIG. 2 is an enlarged view showing the general layout of the outboard drive with the outer housing being shown in phantom.
Figure 3:
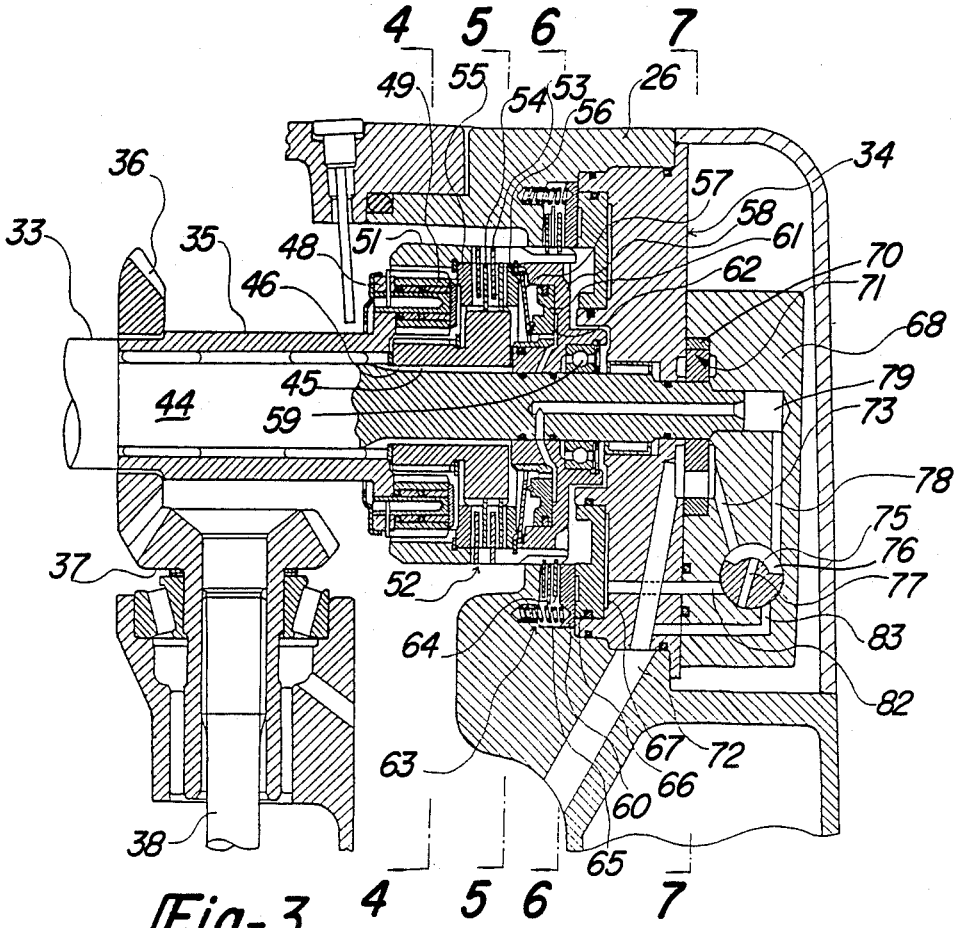
FIG. 3 is an enlarged cross-sectional view showing the transmission of the outboard drive for coupling the input shaft to the drive shaft.
Figure 5:
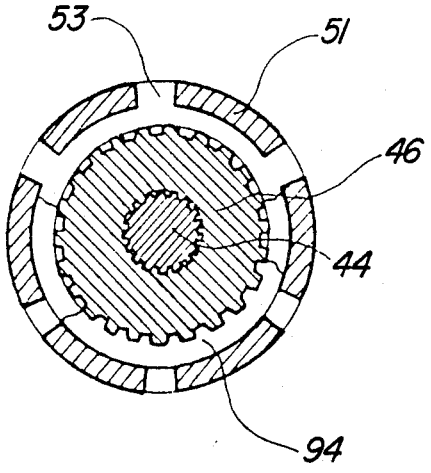
FIG. 5 is a reduced scale, cross-sectional view taken along the line 5—5 of FIG. 3.
Figure 4:
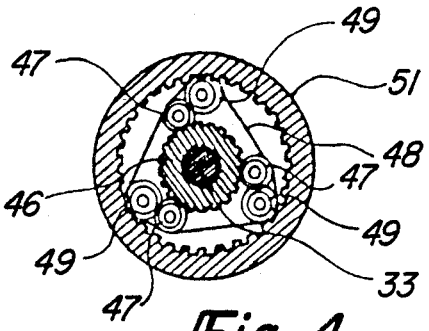
FIG. 4 is a reduced scale, cross-sectional view taken along the line 4—4 of FIG. 3.
Figure 6:
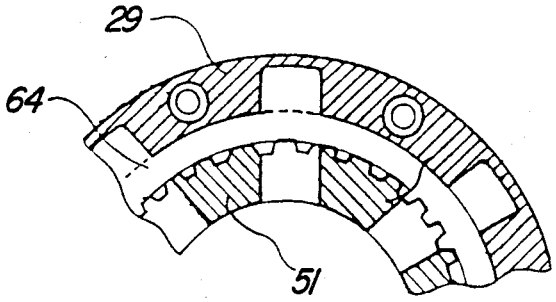
FIG. 6 is a cross-sectional view taken along the line 6—6 of FIG. 3.

Referring now primarily to FIG. 2, the transmission mechanism for driving the propeller 25 from the engine output shaft 24 will be described generally. A double universal joint assembly 32 couples the engine output shaft 24 to a generally horizontally extending input shaft 33 of the outboard drive 21. The double universal joint assembly 32 permits steering movement of the outboard drive and its tilting movement about the pivot pin 28 without interferring with the drive.

The input shaft 33 includes a guill portion, to be described, which forms the input for a transmission mechanism including a selectively operable coupling means, which transmission mechanism is indicated generally by the reference numeral 34 and which is positioned rearwardly in the outer housing 29 so as to not interfere with the degree of pivotal movement of the outer housing 29 relative to the watercraft transom 27.

The transmission means 34 selectively drives a tubular shaft 35 in either a forward or reverse direction for driving a bevel gear 36 that is affixed to the forward end of the tubular shaft 35. The bevel gear 36 is in mesh with a bevel gear 37 that is affixed for rotation to the upper end of a drive shaft 38. The drive sahft 38 is appropriately journaled for rotation within the outer housing 29 about an axis which intersects the axis of the input shaft 33 at the point 39.

A bevel gear 41 is affixed to the lower end of the drive shaft 38 and meshes with a bevel gear 42 that is affixed to the forward end of a propeller shaft 43. The propeller shaft 43 is appropriately journaled within the lower portion of the outer housing 29 and is rotatably coupled to the propeller 25 in any known manner.

Referring now primarily to FIGS. 3 through 10, the transmission mechanism 34 comprises a forward, neutral, reverse transmission and a selectively operable coupling means for coupling the input shaft 33 to the tubular shaft 35 for rotation in a simultaneous forward direction, a neutral condition wherein the tubular shaft 35 is not driven and a reverse condition wherein the tubular shaft 35 rotates in the opposite sense to the input shaft 33. As has been previously noted, the input shaft 33 has a quill portion 44 that extends through the tubular shaft 35 and beyond it wherein it is formed with a splined portion 45 to non-rotatably couple a sun gear 46 to the input shaft 33 on the side opposite to the tubular shaft 35. The sun gear 46 is in mesh with a first series of planet gears 47 that are rotatably journaled by means of a carrier 48. The carrier 48 is formed integrally with one end of the tubular shaft 35. The first series of planet gears 47 are in mesh with a second series of planet gears 49 which are also journaled on the carrier 48. The planet gears 49, in turn, mesh with a ring gear 51.

The ring gear 51 and sun gear 46 are selectively couplable for simultaneous rotation in the same direction and at the same speed by means of a coupling means in the form of a multiple disk friction clutch, indicated generally by the reference numeral 52. To this end, the ring gear 51 is provided with a plurality of circumferentially spaced slotted openings in which are received tabs of driven clutch plates 53 so that the clutch plates 53 will rotate with the ring gear 51. In a similar manner, the sun gear 46 is provided with external splines to which are splined driving clutch plates 54 that are interspersed with the driven clutch plates 53.

The clutch plates 53 and 54 are sandwiched between a pressure plate 55 that is axially affixed to the ring gear 51 and an operable pressure plate 56 that is normally held by a Bellville spring 57 at a spaced location from the pressure plate 55 so that the clutch 52 will be disengaged.

The clutch 52 is hydraulically operated and to this end there is provided a cylinder 58 that is journaled on the input shaft quill portion 44 by means of an anti-friction bearing 59. The cylinder 58 slidably supports an actuating piston 61 that is engaged with the inner periphery of the Bellville spring 57. When the piston 61 is activated by applying fluid pressure to a chamber 62 formed on one side of the piston 61, the pressure plate 56 will be urged toward the pressure plate 55 and the clutch plates 53 and 54 will become engaged so as to couple the ring gear 51 and sun gear 46 for simultaneous rotation so as to drive the tubular shaft 35 in the same direction and at the same speed as the input shaft 33. The mechanism for activating the clutch 54 will be described below.

For driving the tubular shaft 35 in a reverse direction, there is provided a further selectively operable coupling means, indicated generally by the reference numeral 63 and which comprises a fluid operated multiple disk brake. This brake comprises a plurality of brake plates 64 that are received within a fixed recess formed in the housing 29 and which are contained between an inner surface of this recess and a pressure plate 60. The pressure plate 60 is normally urged to a disengaged or released condition by means of a plurality of compression springs 65 which act in an axial direction. The pressure plate 60 is, in turn, engaged by a fluid piston 66 so as to urge the plates 64 into a braking condition. The piston 66 is received within a pressure cavity 67 that is adapted to be pressurized in a manner to be described for engaging the brake 63.

The brake plates 64 have a splined connection to the ring gear 51 so that when the brake 63 is engaged, the ring gear 51 will be held against rotation and, accordingly, the shaft 35 will be drive in a reverse direction from the input shaft 33 by virtue of the intermeshing sets of planetary gears 47 and 49.

The clutch 52 and brake 63 are, as has been previously noted, fluid operated and to that end there is provided a pump housing 68 within the outer housing 29 of the outboard drive unit. The pump housing 68 encloses an end of the quill shaft 44 to which an external gear 69 is coupled for rotation with the shaft 44. The gear 69 is in mesh with an internal gear 70 carried by the pump housing 68 (FIG. 7) so as to form a gerotor type pump, indicated generally by the reference numeral 71.

The upper portion of the housing 29 forms at least, in part, a fluid reservoir that is in communication with an inlet passage 72 that delivers the hydraulic fluid to the pumping cavity of the pump 71. The pressurized fluid is discharged through a pressure passage 73 which, in turn, communicates with a directional control valve 75 having a configuration as best shown in FIGS. 3 and 8 through 10. Specifically, the pressure control valve 75 has a generally cylindrical shape and is rotatably journaled within the pump housing 68. The control valve 75 is a cylindrical member that is journaled in a suitable manner in the pump housing 68 and is formed with an arcuate recess 76 that is intersected at its midpoint by a diametrically extending passage 77.

In addition to the pressure inlet passage 73, the pump housing 68 and outer housing 29 is provided with a plurality of supply passages for activating either the clutch 52 or the brake 63. A first of these supply passages 78 extends to a cavity 79 formed in the pump housing 68 at the area where the quill shaft 44 is journaled. The quill shaft 44 is formed with an axially extending passage 81 that communicates the cavity 79 with the piston chamber 62 for actuating the friction clutch 52.

A further supply passage 82 extends through the pump housing 68 and communicates with the piston chamber 67 for selectively activating the fluid brake 63.

There is also provided a return passage 83 that extends from the valve 75 back to the inlet passage 72.

Figure 8:
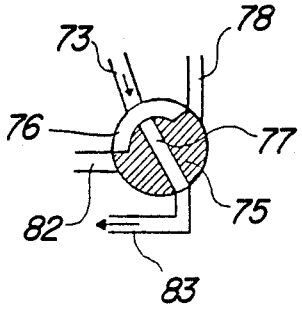
FIG. 8 is a cross-sectional view of the shift control valve showing it in the neutral position.
Figure 7:
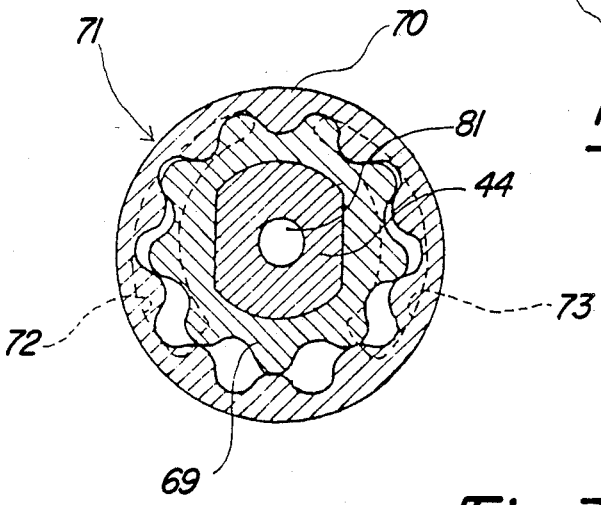
FIG. 7 is a cross-sectional view taken along the line 7—7 of FIG. 3.

FIG. 8 shows the condition of the valve 75 wherein the transmission means 34 is in a neutral condition. In this condition, the valve recess 76 communicates the inlet passage 73 with the return passage 83 so that neither of the passages 78 and 82 are pressurized. In this condition, both the friction clutch 53 and friction brake 63 will be released and the system will operate in neutral wherein the input shaft 33 rotates but the tubular shaft 35 is not driven in either direction.

Figure 9:
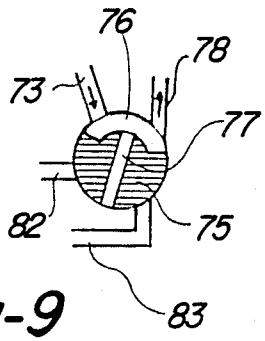
FIG. 9 is a cross-sectional view, in part similar to FIG. 8, showing the shift control valve in the forward position.

In order to shift into forward drive, the valve 75 is rotated in a clockwise direction from the neutral position shown in FIG. 8 to the forward position shown in FIG. 9. When this occurs, the recess 76 will communicate the passageways 73 and 78 and the chamber 62 will be pressurized so as to activate the piston 61 and engage the fluid operated clutch 52 so that forward drive will be accomplished.

Figure 10:
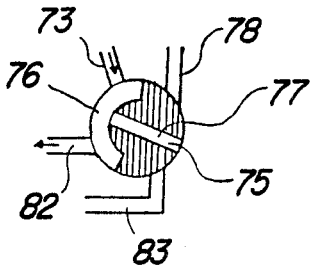
FIG. 10 is a cross-sectional view, in part similar to FIGS. 8 and 9, showing the shift control valve in the reverse position.

If the operator wishes to shift into reverse, the valve 75 is rotated counterclockwise from the position shown in FIG. 8 to the position shown in FIG. 10 wherein the passages 73 and 82 are communicated with each other. This will effect pressurization of the chamber 67 to urge the piston 66 to engage the brake 63 and achieve reverse drive as aforedescribed.

Embodiment Of FIGS. 11 Through 14

In the embodiment of FIGS. 1 through 10, the transmission mechanism 34 comprised a forward, neutral, reverse transmission and selectively operable coupling means for selectively coupling the input shaft 33 to the drive shaft 38 for driving the latter in either a forward, reverse or neutral condition. FIGS. 11 through 14 show another embodiment of the invention wherein the input arrangement to the outboard drive is substantially the same as the previously described embodiment but wherein the transmission means and coupling means take a different form. For that reason, components of this embodiment which are the same as those of the previously described embodiment have been identified by the same reference numerals and will be described again in detail only insofar as is necessary to understand the construction and operation of this embodiment.

Figure 11:
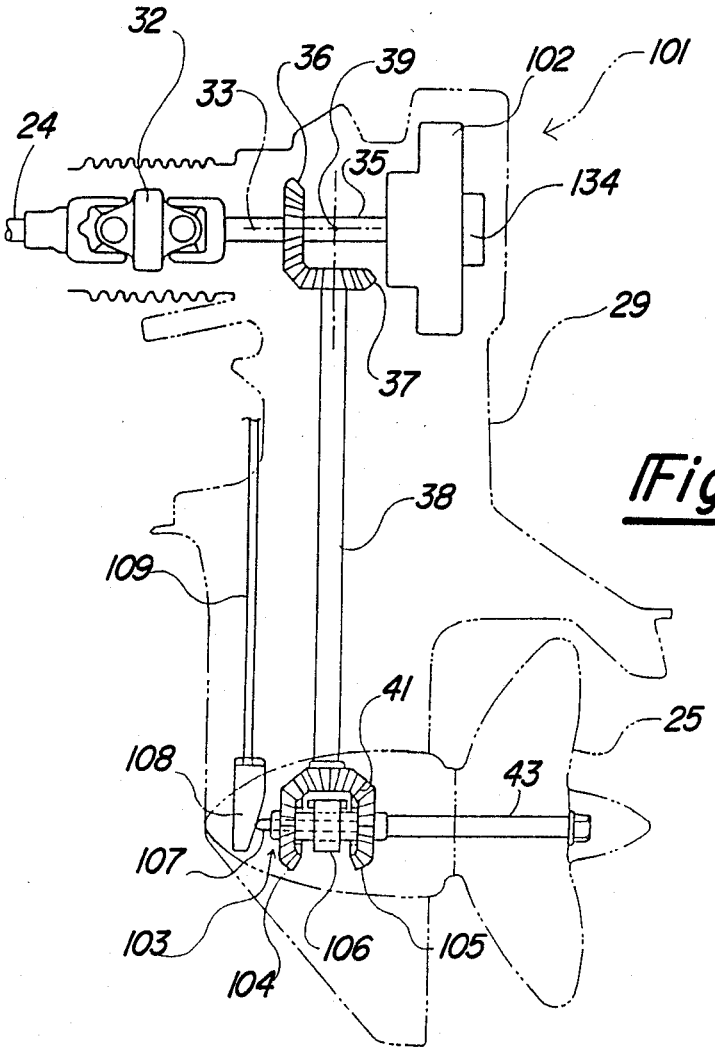
FIG. 11 is a partially schematic side elevational view, in part similar to FIG. 2, illustrating the transmission mechanism of an outboard drive constructed in accordance with a second embodiment of the invention, with the outer housing being shown in phantom.

Referring now in detail primarily to FIG. 11, an outboard drive constructed in accordance with this embodiment is identified generally by the reference numeral 101. Like the previously described embodiment, there is supported for rotation about a generally horizontally disposed axis an input shaft 33 that drives a tubular shaft 35 via a transmission mechanism, indicated generally by the reference numeral 102 that includes selectively operable coupling means. Unlike the previously described embodiment, however, in this embodiment the transmission mechanism 102 does not include a reverse transmission but rather includes a change speed transmission and the coupling mechanism for it.

As a result, the bevel gear 36 and tubular shaft 35 are driven selectively in any of a plurality of forward speed ratios from the input shaft 33. A bevel gear 37 is affixed to the drive shaft 38 and is driven from the bevel gear 36 in the previously described manner. Also, as previously described, the axis of the drive shaft 38 and the axis of the input shaft 33 intersect at a point 39.

The lower end of the drive shaft 38 has affixed to it a bevel gear 41 that is in mesh with a forward, neutral, reverse bevel gear transmission, indicated generally by the reference numeral 103. This transmission 103 includes a pair of oppositely rotating bevel gears 104 and 105 that are in mesh with the gear 41 on its opposite sides. The bevel gears 104 and 105 are journaled on the propeller shaft 43 and are adapted to be selectively coupled for rotation with it by means of a slidably supported dog clutching element 106. The dog clutching element 106 is moved axially by means of a plunger 107 under the operation of a vertically slidable cam 108. The cam 108 is connected to a shift rod 109 so that the operator can selectively couple either of the gears 104 or 105 for rotation with the propeller shaft 43 for driving the propeller 25 in forward or reverse directions as selected, as is well known in this art.

Figure 12:
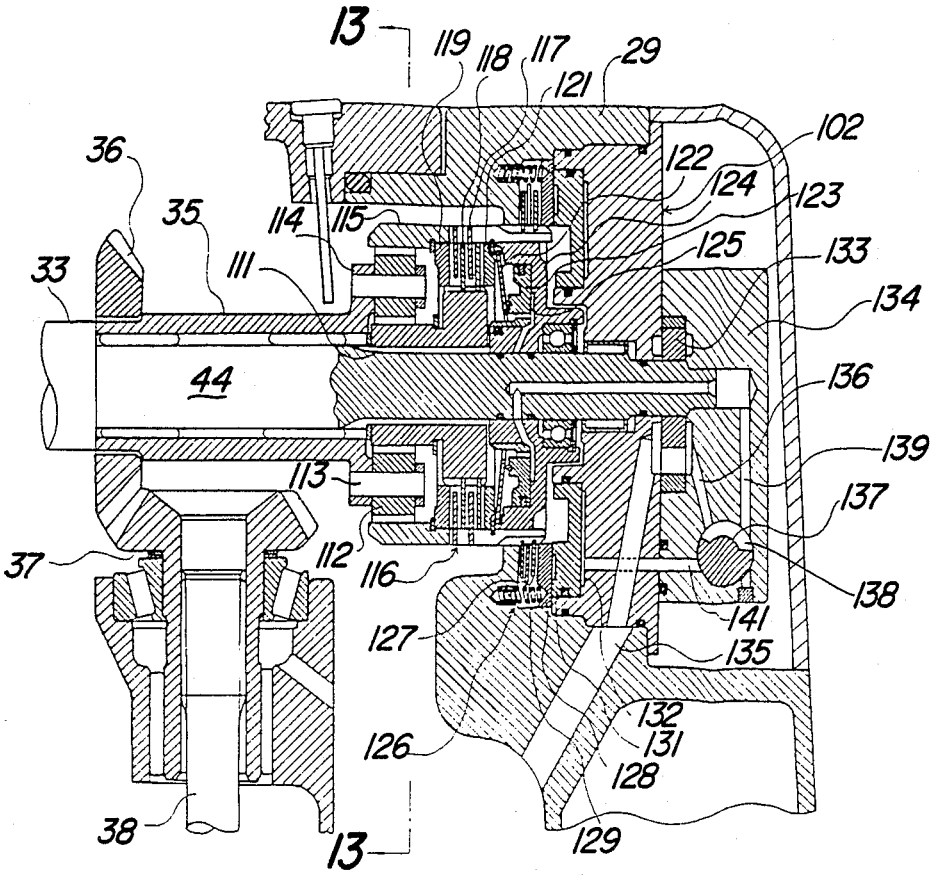
FIG. 12 is an enlarged cross-sectional view of the embodiment of FIG. 11 showing the transmission mechanism for driving the drive shaft from the input shaft.
Figure 13:
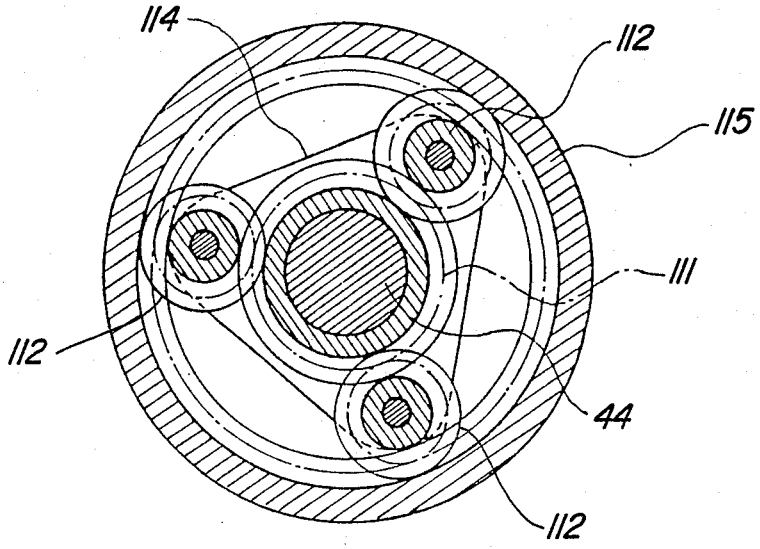
FIG. 13 is a cross-sectional view taken along the line 13—13 of FIG. 12.

Referring now additionally to FIGS. 12 and 13, the details of the transmission mechanism 102 will be described. As with the previously described embodiment, the input shaft 33 has a quill shaft portion 44 that has a splined connection to a sun gear 111. The sun gear 111 is in mesh with a plurality of planet gears 112 that are carried by stub shafts 113 that are affixed to a carrier 114 that is formed integrally with the tubular shaft 35.

The planet gears 112 are in mesh with a ring gear 115. The ring gear 115 is selectably couplable for rotation with the sun gear 111 by means of a hydraulically operated multiple disk friction clutch, indicated generally by the reference numeral 116. The friction clutch 116 includes a plurality of driven plates 117 that have a splined connection to the ring gear 115, as with the previously described embodiment. In a like manner, there are driving plates 118 that are interspersed with the driven plates 117 and which have a splined connection to the sun gear 111. The clutch plates 117 and 118 are stacked between a fixed pressure plate 119 that is fixed to the ring gear 115 and an operable pressure plate 121 that is urged to a released position by means of a Bellville spring 122.

The pressure plate 121 is adapted to be operated by means of a hydraulic piston 123 that is slidably supported within a bore formed in an outer cylindrical member 124. The piston 123 defines with the outer member 124 a fluid pressure chamber 125 that is adapted to be energized so as to pressurize the pressure plate 121 and engage the clutch 116.

There is further provided a selectively operable coupling means in the form of a hydraulically operated multiple disk friction brake 126 for selectively braking the rotation of the ring gear 115. When the ring gear 115 is braked, the tubular shaft 35 will be driven at a reduced speed from the quill shaft 44 through the planetary gear set.

The brake 124 includes a plurality of disk plates 127 that have a splined connection to the ring gear 115. The plates 127 are contained within a recess formed between the housing 29 and a pressure plate 128 that is slidably supported in a bore in this recess. A plurality of coil compression springs 129 normally act against the pressure plate 128 to hold the brake 126 in a released condition. A fluid pressure activated piston 131 is operable under the pressure in a chamber 132 so as to engage the brake, as with the previously described embodiment.

As with the previously described embodiment, the clutch 116 and brake 126 are hydraulically operated by means including a fluid pressure pump that is contained within the housing 29. This pump is indicated generally by the reference numeral 133 and includes an outer housing 134 that is affixed to the outboard drive housing 29 in a suitable manner and which contains a gerotor type pump that is driven by an extension of the quill shaft 44. This pump draws hydraulic fluid from a reservoir formed within the outer drive housing 29 through an inlet passage 135 and pressurizes it to a delivery passage 136. The delivery passage 136 communicates with a selector valve 137 that has a cylindrical shape and which is formed with a recess 138. By suitably rotating the valve 137, the fluid may be delivered under pressure to a first delivery passage 139 that communicates with the pressure chamber 125 for activating the fluid clutch 116. Alternatively, the passage 136 may be communicated with a second delivery passage 141 that communicates the fluid pressure to the brake 126 for operating the brake 126 in the previously described manner. In this embodiment, there is no neutral position since neutral is achieved by means of the transmission contained within the lower unit (transmission 103).

Figure 14:
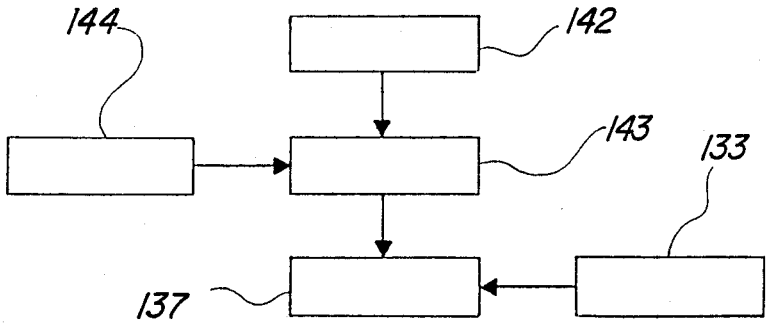
FIG. 14 is a schematic view showing how the automatic transmission mechanism of the embodiment of FIGS. 11 through 13 is operated.

The operation of the clutch 116 or brake 124 to provide high or low speed drive can be done either manually or, in a preferred form of the invention, this is done automatically by a system that operates in accordance with a logic as shown in FIG. 14.

The basic logic under which the automatic transmission selector operates is that if the engine speed is below a predetermined speed (such as 3,000 rpm), the hydraulic system is operated so that the clutch 116 is released and the brake 126 is engaged so as to drive the tubular shaft 35 and drive shaft 38 at a low speed ratio. However, when the predetermined speed is exceeded, the valve 137 is operatd so as to release the brake 126 and engage the clutch 116 and effect drive at the 1 to 1 high speed ratio. To this end, there is provided a speed detector 142 that is responsive to engine speed or speed of the input shaft 33 and which transmits a signal to a shift control mechanism 142 which, in turn, operates the valve 137. There is also provided a power source 144 that inputs power to the shift control mechanism 143 so that the aforedescribed shifting operation can be accomplished.

It should be readily apparent from the foregoing description that several embodiments of the invention have been illustrated and described and each of which provides a coupling means in proximity to the input shaft but positioned rearwardly of the point of intersection of the drive shaft with the input shaft so as to permit free tilting up movement of the outboard drive without any interference from this coupling means. Although several embodiments of the transmission and coupling mechanisms have been illustrated and described, various other arrangements may be employed without departing from the spirit and scope of the invention, as defined by the appended claims.

We claim:

1. In an outboard drive arrangement for a watercraft comprising an outer housing adapted to be supported for pivotal movement relative to a transom of the watercraft about a generally horizontally extending pivot axis, a generally horizontally extending input shaft journaled within said outer housing and extending rearwardly therein, a drive sahft journaled for rotation about a generally vertically extending axis within said outer housing and forwardly of the rear end of said input shaft, transmission means for driving said drive shaft from said input shaft comprising at least one gear on said input sahft and at least one gear on said drive shaft, said gears being located contiguous to said drive shaft and forwardly of the rear end of said input shaft, and propulsion means driven by the lower end of said drive shaft for powering the associated watercraft, the improvement comprising coupling means positioned rearwardly within said outer housing from all gears of said transmission means and from said drive shaft and at the end of said input shaft for coupling said input shaft to said one gear on said input shaft for driving said drive shaft.

2. In an outboard drive arrangement as set forth in claim 1 wherein the coupling means is selectively operable.

3. In an outboard drive arrangement as set forth in claim 2 wherein the coupling means comprises a clutch.

4. In an outboard drive arrangement as set forth in claim 3 wherein the clutch is a friction clutch.

5. In an outboard drive arrangement as set forth in claim 4 wherein the friction clutch is fluid operated.

6. In an outboard drive arrangement as set forth in claim 5 wherein the fluid for the clutch operation is provided by means of a pumping element driven by the input shaft and positioned rearwardly of the coupling means.

7. In an outboard drive arrangement as set forth in claim 6 wherein the fluid operated clutch operates a change speed transmission.

8. In an outboard drive arrangement as set forth in claim 2 wherein the transmission comprises a selectively operable change speed transmission.

9. In an outboard drive arrangement as set forth in claim 8 wherein the transmission comprises a planetary transmission.

10. In an outboard drive arrangement as set forth in claim 9 wherein the transmission comprises a forward, neutral, reverse transmission.

* * * * *